United States Patent [19]

Yagi

[11] 4,414,988

[45] Nov. 15, 1983

[54] TOBACCO SMOKE FILTER

[75] Inventor: Michiko Yagi, Tokyo, Japan

[73] Assignee: Kabushiki Kaisha Advance Kaihatsu Kenkyujo, Nihonbashi, Japan

[21] Appl. No.: 294,991

[22] Filed: Aug. 21, 1981

[30] Foreign Application Priority Data

Aug. 23, 1980 [JP] Japan ..... 55-116144

[51] Int. Cl.[3] ..... A24D 3/00; A24D 3/14; A24D 3/16

[52] U.S. Cl. ..... 131/334

[58] Field of Search ..... 131/334, 335, 337

[56] References Cited

U.S. PATENT DOCUMENTS 2,739,913 3/1956 Lieser ..... 131/334

3,355,317 11/1967 Keith et al. ..... 131/334

4,071,037 1/1977 Scheinberg ..... 131/334

OTHER PUBLICATIONS

Biochemical & Biophysical Research Communications, vol. 92, No. 2, pp. 662–668, (1980).

Chem.-Biol. Interactions, 10, 57–70, (1975).

*Primary Examiner*—V. Millin

*Attorney, Agent, or Firm*—Finnegan, Henderson, Farabow, Garrett & Dunner

[57] ABSTRACT

A tobacco smoke filter capable of effectively removing carcinogenic substances from tobacco smoke is presented. This tobacco filter contains an aqueous solution of a compound having a metallic ion or especially ferric ion binding protoporphyrin ring structure, as a removal agent of carcinogenic substances from the tobacco smoke, and a porous carrier therefor.

10 Claims, 6 Drawing Figures

NUMBERS OF HIS+ REVERTANS COLONIES
%
100
50
0
0
0.013
0.033
0.065
0.130
HEMIN (mg / PLATE)

TOBACCO SMOKE FILTER

The present invention relates to a tobacco smoke filter suitable for use in the removal of carcinogenic and/or harmful substances included in tobacco smoke during smoking.

Known in the art as main components of the carcinogenic substances included in tobacco smoke are benzo (α) pyrene (it sometimes refers to as "BP" for brevity hereinbelow) and the derivatives thereof. In order to remove these carcinogenic substances (e.g. benzo (α) pyrene and derivatives thereof) from tobacco smoke, tobacco smoke filters having materials into which proteins such as milk serum protein, egg white protein, egg white protein and the like, and vegetable oils such as corn oil, sunflower seed oil and the like are incorporated have been proposed in the art. However, since the bonding of these proteins and vegetable oils with benzo (α) pyrene and the derivatives thereof is not strong and since the anti-carcinogenic capability due to the bonding is not strong as proportional to the bonding strength, the complete capturing of benzo (α) pyrene and the derivaties thereof is difficult and the maintenance of the initial property of the proteins and the vegetable oils to capture benzo (α) pyrene and the derivatives thereof with the lapse of time is difficult. Therefore, the use of these proteins and vegetable oils in tabacco smoke filters is not suitable.

Accordingly, the main object of the present invention is to provide a tobacco smoke filter which is capable of effectively removing carcinogenic substances from the tobacco smoke containing the same.

Another object of the present invention is to provide a tobacco smoke filter by which the flavoring taste of the tobacco smoke is not impaired as compared with the conventional tobacco smoke filters.

Other objects and advantages of the present invention will be apparent from the description set forth hereinbelow.

In accordance with the present invention, there is provided a tobacco smoke filter comprising an aqueous solution of at least one compound having a metallic ion and especially ferric iron binding protoporphyrin ring structure, as a removal agent of carcinogenic or harmful substances from the tobacco smoke, and a porous carrier therefor.

The present invention will be better understood from the following description given in connection with the accompanying drawings in which.

Figure 1:
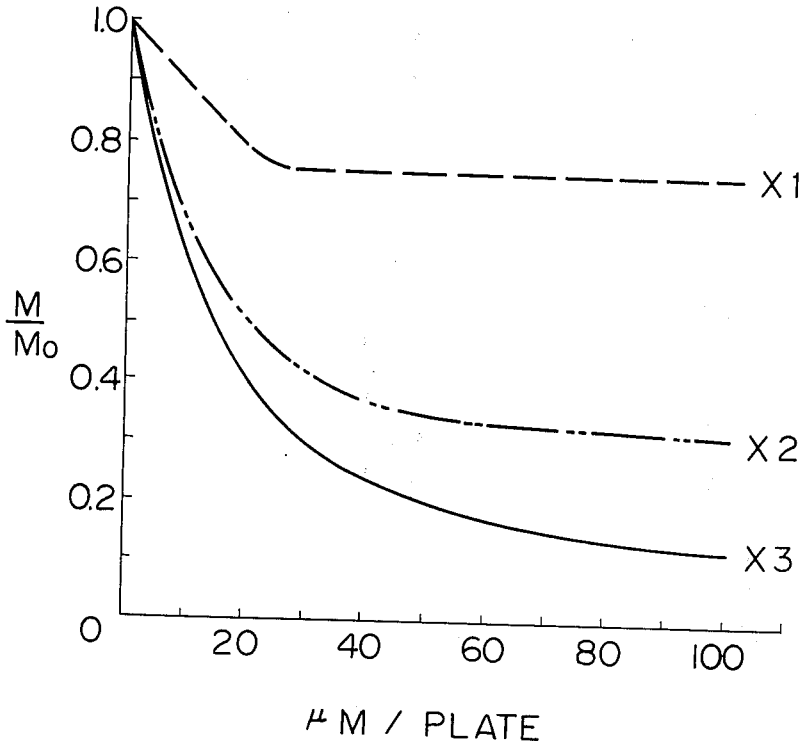
FIG. 1 is a graphical drawing illustrating the correlations between the effect of the desmutagenicity (or anti-mutagenicity) (M/Mo) and the concentrations of the various organic compounds each having a metallic ion binding protoporphyrin ring structure.

I have tried to find a substance X which is capable of strongly bonding to benzo (α) pyrene and the derivatives thereof, whereby the benzo (α) pyrene is converted to those which are not carcinogenic substances, and also which is capable of stably maintaining its initial desired property for a relatively long period of time, in view of the following points.

(1) The substance X which is to be bonded to benzo (α) pyrene and the derivatives thereof nontoxic to a living body.

(2) The use of chemically synthesized products should be avoided as much as possible, because the substance X should be harmless as mentioned in (1) above. Accordingly, the substance X should be naturally occurring substances which are harmless to a living body.

Partial examples of the compounds which have been subjected to the screening are: transition metal compounds such as $FeCl_3$, $CuCl_2$, $ZnCl_2$, $NiCl_2$ and the like; amines such as 3,3'-diaminodipropylamine, p-phenylenediamine, hydroxylamine, histamino and the like; porphyrins such as hemin, heme and the like; iron-containing proteins such as ferritin and the like; hemoproteins such as catalase, oxyhemoglobin, methemoglobin and the like.

In the case where the substance X is selected from the above-mentioned compounds, the following two indices are used.

Index I: the bonding strength of the substance X with benzo (α) pyrene and the derivatives thereof, by which the carcinogenic property of benzo (α) pyrene and the derivatives thereof is removed.

Index II: Desmutagenicity effect of benzo (α) pyrene and the derivatives thereof.

Determination Method of Index I

The bonding strength of the substance X with benzo (α) pyrene is determined as follows.

Mixtures of the substance X and benzo (α) pyrene having various concentrations are developed, on (non-fluorescent) Merk No. 5641 TLC (thin layer chromatography) plates, for 10 minutes by using a mixed solvent of methanol:water (3:1). After the development, the free benzo (α) pyrene, which is not bonded to the substance X, is taken out of the TLC plate and extracted with 1 ml of dimethyl sulfoxide (DMSO). The fluorescence intensity in the DMSO extraction solution is measured at λ excitation of 384 nm and λ emission of 410 nm, which is the absorption wavelength and the fluorescence wavelength of benzo (α) pyrene, respectively.

Assuming that the fluorescence intensity (Fo) of benzo (α) pyrene in DMSO is 100 when no substance X is contained, the ratio of F/Fo, wherein F is a relative fluorescence intensity when the substance X is contained, is defined as the concentration of the free benzo (α) pyrene, which is not bonded to the substance X.

Furthermore, a bonding constant Kass (i.e. the ratio of the bonding based on 1 mol of the substance X) is obtained by drawing the following relationship (1) in which the correlation between Fo and F is shown.

$$(Fo/F) = 1 + Kass\ (X) \quad (1)$$

The bonding of the substance X with benzo (α) pyrene becomes large as the constant Kass obtained from the equation (1) is increased.

Determination Method of Index II

The desmutagenicity is determined according to a mutation assay method of Ames (Ames et al., Mutation Res. 31, 347('75) by using *Salmonella typhimurium* TA-100 auxotroph strain.

In the indication of the mutagenicity of benzo (α) pyrene, the mutation colonies are counted after incubating for 2 days at a temperature of 34° C. Thus, the mutation intensity is determined. That is, assuming that the number of the colonies (Mo) at 3.7 micromol of benzo (α) pyrene per plate is 100 when no substance X is contained, the ratio of M/Mo, wherein M is a relative colony number when the substance X is contained, is defined as the mutagenicity of the benzo (α) pyrene.

A mutation constant Kmut is obtained by drawing the following relationship (2), in which the correlation between Mo and M is shown.

$$(Mo/M)=1+Kmut\ (X) \qquad (2)$$

The desmutagenicity becomes large as the mutation constant Kmut is increased.

According to the test results obtained as mentioned above, the compounds having a protoporphyrin ring and especially containing ferric iron ($Fe^{3+}$) therein have been observed as desirable for use in the present invention. This is clear from the results shown in the attached drawings, in which the test results of the index II are illustrated.

As mentioned hereinabove, in FIG. 1, the characteristic curves based on the test results of the index II are shown. That is, the correlations of the desmutagenicity (M/Mo) versus the concentrations of catalase (curve $X_1$), methemoglobin (curve $X_2$) and hemin (curve $X_3$) are graphically illustrated in FIG. 1.

As is clear from the results shown in curves $X_1$, $X_2$ and $X_3$ of FIG. 1, the desmutagenicity of the organic compounds having a metallic ion and especially ferric ion binding protoporphrin ring structure, such as, catalase, methemoglobin and hemin becomes large as the concentration thereof is increased. From this fact, it is understood that the organic compounds having a protoporphirin ring structure and, especially, containing ferric iron ($Fe^{3+}$) have such a property that the carcinogenic property of benzo (α) pyrene and the derivatives thereof disappears.

The difference in the effect of the desmutagenicity of the organic compounds of curves $X_1$, $X_2$ and $X_3$ in FIG. 1 are based on the differences in the percentage of the protein (i.e. molecular weight) in the organic compounds. That is to say, the effect of the desmutagenicity against benzo (α) pyrene and the derivatives thereof is decreased as the percentage of the protein in the organic compounds is increased. It is believed that the presence of the protein prevents the bonding of the organic compounds to benzo (α) pyrene and the derivatives thereof. That is, among these organic compounds of curves $X_1$, $X_2$ and $X_3$, hemin which is the derivatives of porphyrin having no protein structure therein is most effective.

Furthermore, in order that the carcinogenic property is eliminated from tobacco smoke by such a mechanism that living bodies are not adversely affected, it is desired that the correlation between the bonding constant and the desmutagenicity constant is approximately identical to each other (i.e. correlation coefficient is approximately 1.0). In this respect, the above-mentioned organic compounds of curves $X_1$, $X_2$ and $X_3$ in FIG. 1 fulfills the above-mentioned conditions. For instance, the correlation of hemin is shown in Table 1 below, together with the control compounds.

TABLE 1

| Compound | Bonding Constant Kass ($mol^{-1}$) | Desmutagenicity Constant Kmut ($mol^{-1}$) |
|---|---|---|
| a. $FeCl_3$* | 525 | 520 |
| b. $CuCl_2$ | 850 | $2.3 \times 10^4$ |
| c. Hemin | $8.0 \times 10^4$ | $7.0 \times 10^4$ |

*Control

As is clear from the results shown in Table 1 above, since hemin has (i) a maximum large bonding constant to benzo (α) pyrene, (ii) a maximum large desmutagenicity constant against benzo (α) pyrene and (iii) approximately identical bonding constant and desmutagenicity constants (i.e. the correlation coefficient≃1.0), hemin is the most suitable compound as the substance X.

According to the present invention, as mentioned hereinabove, the carcinogenic property of benzo (α) pyrene and the derivatives thereof can be eliminated by the use of the compounds having a protoporphyrin ring structure due to the fact these compounds are bonded to benzo (α) pyrene and the derivative thereof, whereby the carcinogenic property thereof disappears. As a result, the tobacco smoke filter, by which tobacco smoke having a remarkably decreased content of the carcinogenic substances can be smoked is provided.

Typical examples of the tobacco smoke filters of the present invention will now be explained, in detail, below, with reference to the attached FIGS. 2 and 3, in which hemin is used as the compound having a protoporphyrin ring structure (i.e. a removal agent).

Figure 2:
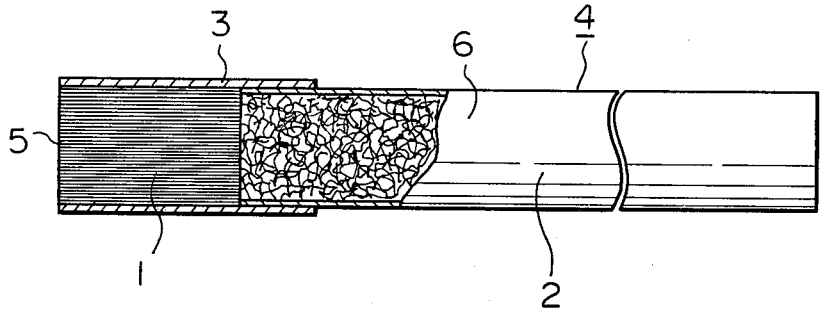
FIG. 2 is a schematic partially broken sectional view of a cigarette to which an example of the tobacco smoke filter according to the present invention is applied.

FIG. 2 is a partially broken sectional view of a cigarette to which an example of the tobacco smoke filter of the present invention is applied. That is, a tobacco smoke filter 1 of the present invention is incorporated into a cigarette 2. In FIG. 2, the reference numeral 3 is a wrapping material, 4 a cigarette, 5 a suction side and 6 a combustion side portion.

Figure 3:
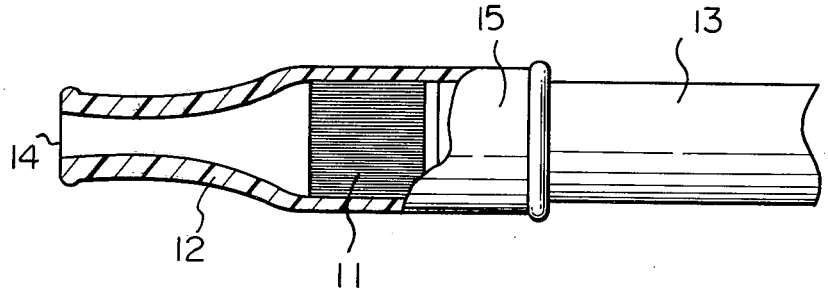
FIG. 3 is a schematic partially broken sectional view of a pipe to which an example of the tobacco smoke filter according to the present invention is applied.

FIG. 3 is a partially broken sectional view of a pipe to which an example of the tobacco smoke filter of the present invention is applied. In FIG. 3, a tobacco smoke filter 11 of the present invention is incorporated into a pipe 12. The reference numeral 13 is a cigarette, 14 a suction side and 15 a combustion side portion.

In the embodiments illustrated in FIGS. 2 and 3, the tobacco smoke filters 1 and 11 comprise a porous carrier to which a solution of hemin in a solvent such as a diluted alkaline solution is impregnated. The porous carriers used in the present invention can be any convention can be any conventional filter materials, such as, acetate fibers, polyvinyl acetal type porous materials and the like. In addition to these materials, matrices made of cellulose fibers or glass fibers, or activated carbon and the like can also be used as a porous carrier.

Although hemin is impregnated into a filter material or carrier in the examples illustrated in FIGS. 2 and 3, the incorporation of the removal agent of carcinogen substances, such as hemin, into a cigarette, a pipe and the like can be in any known manner. For instance, hemin can be capsulated into a rupturable capsule and, then, the capsule is ruptured when smoking, whereby the hemin is impregnated into the filter material or carrier. Furthermore, hemin can be directly impregnated into one end of a cigarette, whereby the impregnated portion serves as a filter. In addition, particle materials made of hemin to which a solvent is impregnated can be included in the filter material or carrier.

Although it is described in the examples shown in FIGS. 2 and 3 that the tobacco smoke filters are applied to a cigarette and pipe, a so-called water pipe device in which a solution of hemin diluted with a solvent is contained and through which tobacco smoke passes can be also used.

As experimental results, the correlations of the percentages of the free benzo (α) pyrene A' (%) (i.e. F/Fo×100) and the percentages of the mutagenicity B' (%) (i.e. M/Mo×100) versus the concentration of hemin (micromol) are shown in Table 2 below. In Table 2, A' is a relative value assuming that the fluorescence intensity (Fo) of the benzo (α) pyrene at a concentration of 3.7 micromol is 100 when no hemin is included. B' is a relative value assuming that the number of the mutation colonies of *Salmonella typhimurium* Ta-100 strain at a molar concentration of 3.7 micromol is 100 when no hemin is included.

TABLE 2

| Concentration of Hemin (M) | A' | B' |
|---|---|---|
| 0 | 100 | 100 |
| 10 | 40.4 | 54.0 |
| 20 | 30.0 | 40.0 |
| 30 | 23.0 | 30.0 |
| 40 | 19.0 | 23.0 |
| 50 | 15.0 | 17.0 |
| 60 | 12.5 | 14.0 |
| 70 | 11.0 | 11.0 |
| 80 | 9.6 | 9.0 |
| 90 | 7.0 | 7.0 |
| 100 | 5.0 | 5.0 |
| 110 | 4.0 | 4.0 |
| 120 | 3.0 | 3.0 |
| 130 | 2.0 | 2.0 |
| 140 | 0 | 0 |

In these experiments, in order to determine the bonding capacity of hemin to benzo (α) pyrene and the desmutagenicity of hemin, 2.7 ml of benzo (α) pyrene having a molar concentration of 3.7 micromol was used. Since the molecular weight of hemin is 252.3, the weight of benzo (α) pyrene ued in the experiment was approximately 2.52 micrograms.

The content of benzo (α) pyrene and the derivatives thereof contained in the smoke generated from 100 cigarettes is 0.2 through 12.25 micrograms (see Adv. Cancer Res., Vol. 8, p. 249, 1964). Accordingly, the amount of the benzo (α) pyrene used in the above experiment is that generated from the smoking of about 21 through about 1260 cigarettes.

As is clear from Table 2 above, in order to completely make benzo (α) pyrene in the tobacco smoke harmless, the use of at least 140 micromol of the hemin solution used in the above experiments is necessary. This amount corresponds to at least approximately 0.246 mg of hemin from the calculation based on the facts that the liquid volume of the hemin solution is 2.7 m and the molecular weight of hemin is 651.94.

Figure 4:
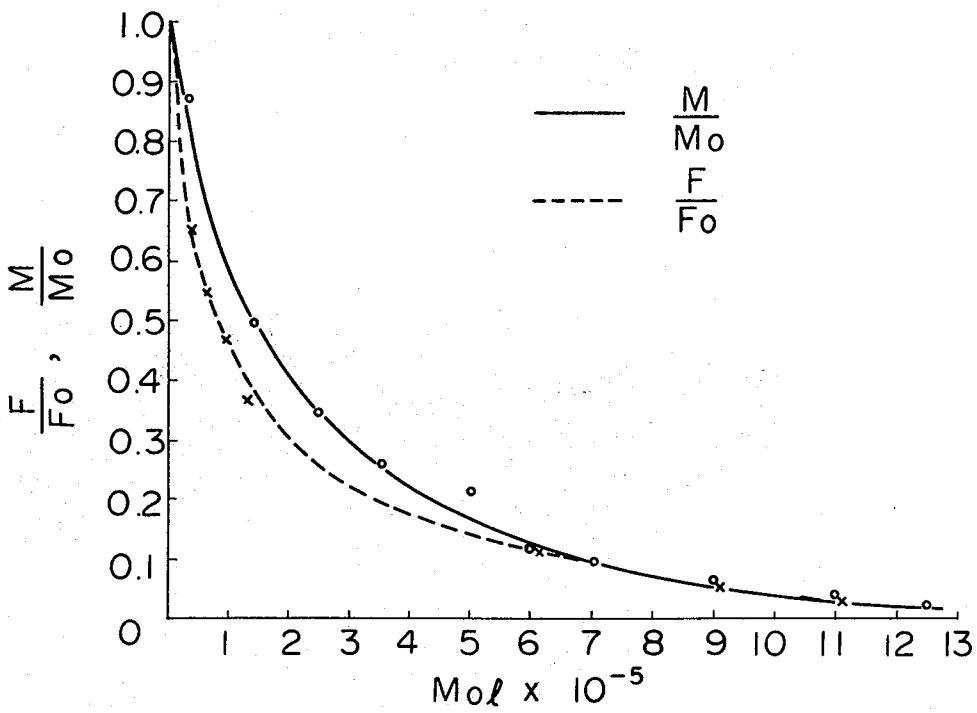
FIG. 4 is a graphical drawing illustrating the correlation between the bonding ratio (F/Fo) of hemin with benzo (α) pyrene and the concentration of hemin and also the correlation between an effect of the desmutagenicity (M/Mo) and the concentration of hemin.
Figure 5:
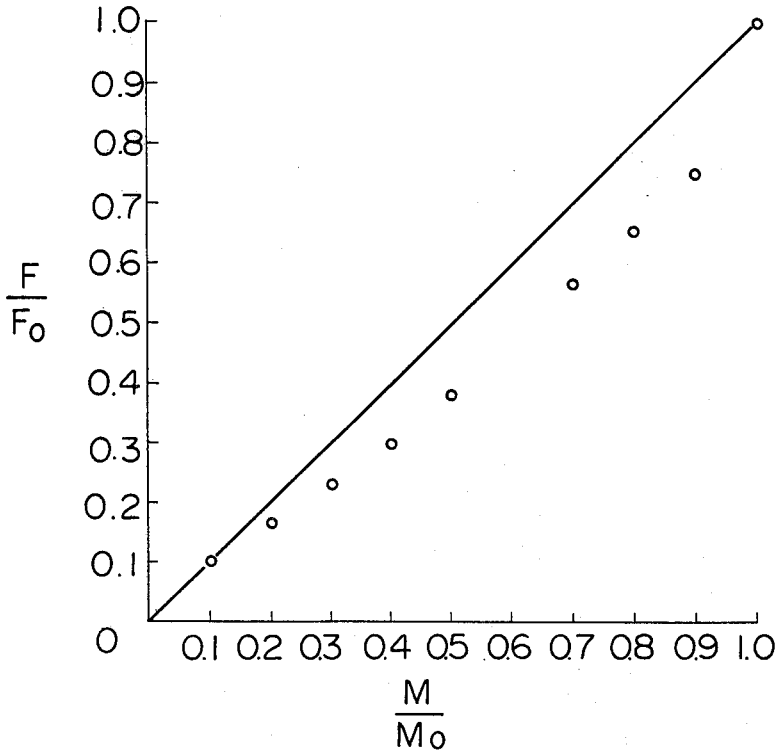
FIG. 5 is a graphical drawing illustrating the correlation between (F/Fo) and (M/Mo) when hemin is used.

The correlations of the relative bonding capacity F/Fo and the relative desmutagenicity (M/Mo) versus the concentration of hemin (mol×$10^{-5}$) listed in Table 2 above are shown in FIG. 4. As is clear from the curves in FIG. 4, both curves (i.e. F/Fo vs hemin concentration and M/Mo vs hemin concentration) are approximately consistent with each other. Thus, as shown in FIG. 5, a correlation coefficient of F/Fo to M/Mo is approximately or nearly 1.0. This means that the carcinogenic property of benzo (α) pyrene can be eliminated by the bonding of hemin with the benzo (α) pyrene.

Figure 6:
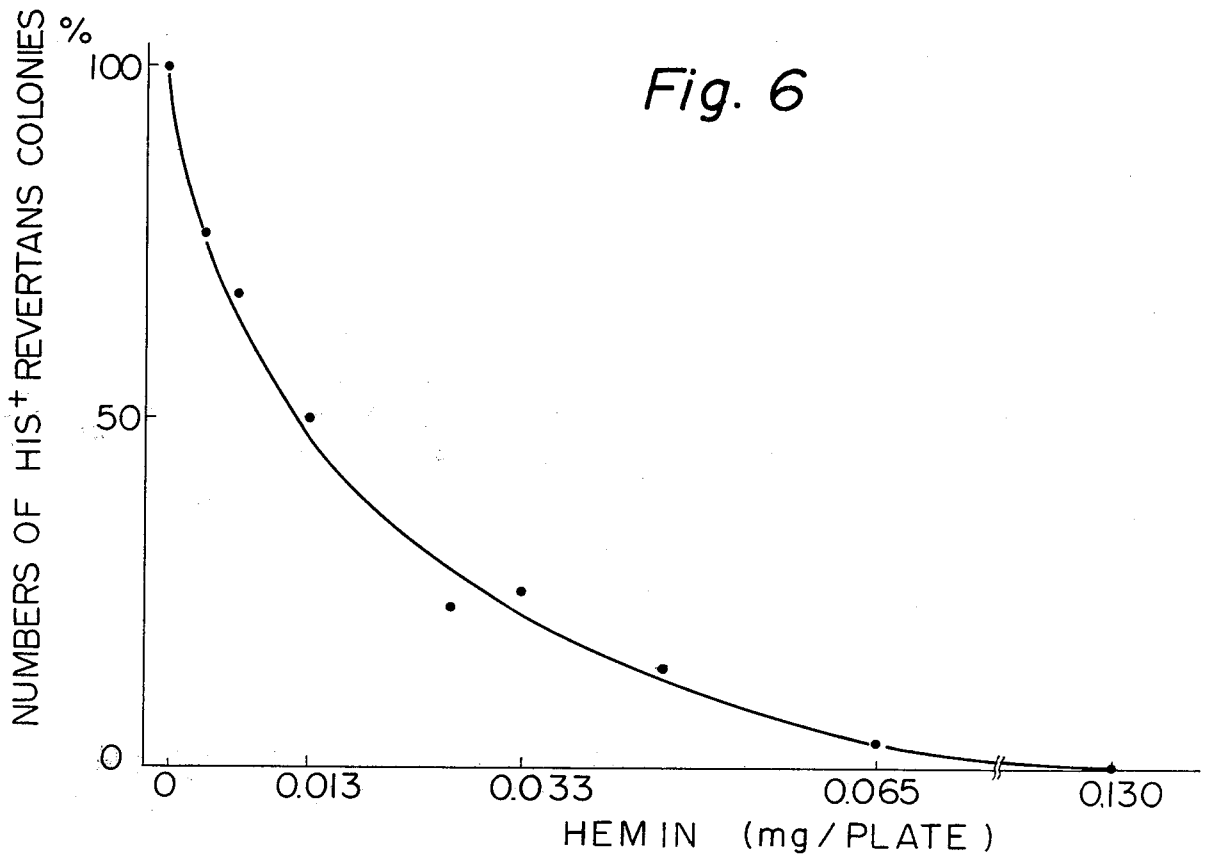
FIG. 6 is a graphical drawing illustrating the correlation between numbers of his+ revertants colonies and the concentration of hemin when Salmonella TA 98 strain per microsome system of Ames et al., as modified by Yahagi et al., is used.

FIG. 6 is a graphical drawing illustrating the correlations between numbers of his+ revertants colonies and the concentration of hemin in the case where Salmonella TA 98 strain is cultivated in a culture medium added with tobacco smoke condensate of 0.1 pieces per plate and where the amounts of the hemin are changed. Thus, the desmutagenic effect of the hemin can be observed. Similar results were obtained in the case where other compounds having a metallic ion binding propophyrin ring structure were used. Thus, according to the present invention, not only benzo (α) pyrene but also other carcinogenic substances contained in tobacco smoke can be effectively made harmless by the use of the compounds having a metallic ion binding protoporphyrin ring structure such as hemin.

In addition to the compounds having a metallic ion binding protoporphyrin ring structure such as hemin, methemoglobin, catalase and the like, the derivatives thereof, for example, various intramolecular metal complexes are also useful compounds in the present invention. Especially, various derivatives of hemin, for example, compounds, such as hematin, in which the acid anion is coordinated, and various intramolecular metal complexes such as the Mg complex salt in which Fe (III) is replaced with Mg (II) have activities substantially similar to those of hemin.

As explained hereinabove, according to the present tobacco smoke filter, since compounds having a metallic ion binding protoporphyrin ring structure, which can be selectively and strongly bonded to benzo (α) pyrene and the derivatives thereof, are present between the suction side and the combustion side of a cigarette, the carcinogenic properties of the carcinogenic substances, such as benzo (α) pyrene and the homologue thereof, derived from a cigarette during smoking can be very effectively removed from the tobacco smoke.

Especially when hemin or the derivative thereof is used so shown hereinabove, since the bonding percentage of hemin with benzo (α) pyrene is large, the use of a very small amount of hemin results in the desired effect as calculated hereinabove. In addition, since the desmutagenic effect of the hemin is large and the correlation of the bonding capability and the desmutagenicity of the hemin is consistent with each other (i.e. the correlation coefficient≃1), the hemin is very effectively and strongly bonded to the benzo (α) pyrene, the carcinogenic property of the benzo (α) pyrene is very effectively removed or eliminated.

In the case where the tobacco smoke filter of the present invention is used in a cigarette, a pipe or the like, the benzo (α) pyrene contained in the tobacco smoke during smoking can be certainly removed from the tobacco smoke during smoking by using 0.1 microgram through 10 mg, preferably 0.1 through 2 mg of at least one above-mentioned compound having a metallic ion and especially ferric ion binding protoporphyrin ring structure (e.g. hemin and its derivatives), based on one conventional cigarette. However, it should be noted that the amount of the compounds having a metallic ion binding protoporphyrin ring structure can be varied based on the generation amount of the carcinogenic substances in the tobacco smoke, which depends upon the kinds of tobacco or cigarette, the type of smoking, the smoke intake rate, the size of tobacco or cigarette and the like.

The concentration of the active compounds having a protoporphyrin ring structure such as hemin and the like in, for example, an aqueous solution thereof or the impregnated amount thereof to the filter can be appropriately selected, so that the total amount of the active compounds is within the above exemplified range.

For example, a porous filter substrate (or carrier) of substantially columnar shape contained in a hollow chamber of cylindrical holder body is suitably impregnated with an aqueous solution of hemin or its homologous, which has a concentration in the range of 0.1 to 20, preferably, 0.5 to 10 mM and in an amount in the range of 0.1 to 1.5, more preferably, 0.1 to 0.8 ml.

Furthermore, according to one another feature of the present invention, the flavoring taste of the tobacco smoke by using the smoke filter of the present invention is never damaged but unexpectedly improved, perhaps, by the specific column chromatographic properties of this smoke filter.

Having described only typical preferred forms and applications of the invention, I do not wish to be limited to the specific details herein set forth, but wish to reserve to myself any modifications and/or variations that may appear to those skilled in the art and which fall within the scope of the following claims.

I claim:

1. A tobacco smoke filter comprising an aqueous solution of at least one compound having a metallic ion binding protoporphyrin ring structure as a removal agent of carcinogenic substances from tobacco smoke, and a porous carrier or container therefore, said compound in the aqueous solution being present at a concentration ranging from 0.1 to 20 mM, said concentration being sufficient for effectively removing said carcinogenic substances from the tobacco smoke.

2. A tobacco smoke filter of claim 1, in which said compound is defined as a compound having a ferric ion binding protoporphyrin ring structure.

3. A tobacco smoke filter of claim 2, in which said compound is selected from the group consisting of catalase, Methemoglobin, hemin and their derivatives.

4. A tobacco smoke filter of claim 1, in which said compound substantially consists of a ferric ion binding protoporphrin ring.

5. A tobacco smoke filter of claim 4, in which said compound is selected from the group consisting of hemin, hematin and their derivatives.

6. A tobacco smoke filter of claim 1, wherein said carcinogenic substances removed are benzo ($\alpha$) pyrene and derivatives thereof and wherein said at least one compound is hemin.

7. A tobacco smoke filter comprising a substantially cylindrical holder body having a hollow chamber constricted to be of small diameter to define a mouthpiece at one end and having an opening at the other end dimensioned to insert therein the end of a cigarette, and a porous filter substrate of substantially columnar shape contained in said chamber for filtering the tobacco smoke passing therethrough, said filter substrate being impregnated with an aqueous solution of hemin and/or its derivatives, said hemin and/or its derivatives being present in a concentration ranging from 0.1 to 20 mM, said concentration being sufficient for effectively removing carcinogenic substances from the tobacco smoke passing through said filter.

8. A tobacco smoke filter of claim 7, in which said aqueous solution of hemin and/or its derivatives has a concentration in the range of 0.5 to 10 mM and an amount in the range of 0.1 to 1.5 ml.

9. A tobacco smoke filter of claim 7 or 8, in which said derivative of hemin is hematin.

10. A tobacco smoke filter of claim 7, wherein said carcinogenic substances removed are benzo ($\alpha$) pyrene and derivatives thereof and wherein said filter substrate is impregnated with an aqueous solution of hemin.

* * * * *

UNITED STATES PATENT AND TRADEMARK OFFICE

CERTIFICATE OF CORRECTION

PATENT NO. : 4,414,988

DATED : November 15, 1983

INVENTOR(S) : MICHIKO YAGI

It is certified that error appears in the above—identified patent and that said Letters Patent is hereby corrected as shown below:

On the title page:

Please change the assignee to read --KABUSHIKIKAISYA ADVANCE KAIHATSU KENKYUJO--.

Signed and Sealed this

*Twenty-first* Day of *February 1984*

[SEAL]

*Attest:*

GERALD J. MOSSINGHOFF

*Attesting Officer*

*Commissioner of Patents and Trademarks*